US005720183A

United States Patent [19]

Chang

[11] Patent Number: 5,720,183

[45] Date of Patent: Feb. 24, 1998

[54] WATER TRAP CUP

[75] Inventor: Eric E-Lee Chang, Louisville, Ky.

[73] Assignee: General Electric Company, Louisville, Ky.

[21] Appl. No.: 710,426

[22] Filed: Sep. 17, 1996

[51] Int. Cl.[6] ..... F25D 21/14

[52] U.S. Cl. ..... 62/285; 4/681; 4/695

[58] Field of Search ..... 62/285, 288, 291; 138/37, 39; 4/679, 681, 695

[56] References Cited

U.S. PATENT DOCUMENTS

| | | | |
|---|---|---|---|
| 695,311 | 3/1902 | Hickey . | |
| 1,525,845 | 2/1925 | Williams . | |
| 2,049,799 | 8/1936 | Candor . | |
| 2,485,115 | 10/1949 | Saunders . | |
| 2,582,031 | 1/1952 | Harbison . | |
| 2,982,115 | 5/1961 | Wurtz et al. | 62/288 |
| 3,050,957 | 8/1962 | Robbie . | |
| 3,696,632 | 10/1972 | Carlin et al. . | |
| 3,774,408 | 11/1973 | Pruehs . | |
| 3,910,061 | 10/1975 | Irwin | 62/290 |
| 5,069,042 | 12/1991 | Stuchlik | 62/284 |
| 5,392,613 | 2/1995 | Bolton et al. | 62/262 |

FOREIGN PATENT DOCUMENTS

| | | | |
|---|---|---|---|
| 4-28988 | 1/1992 | Japan . | |
| 4-302980 | 10/1992 | Japan . | |
| 5-60452 | 3/1993 | Japan . | |
| 406018146 | 1/1994 | Japan | 62/291 |
| 6-18146 | 1/1994 | Japan . | |

*Primary Examiner*—William Doerrler
*Attorney, Agent, or Firm*—H. Neil Houser

[57] ABSTRACT

A water trap cup for use in connection with a drain tube in a refrigerator is described. In one embodiment, the water trap cup includes a bottom wall and a side wall extending from the bottom wall. The side wall includes retaining webs configured for retaining an end of the drain tube within the water trap cup, and a bottom stop extends from the side wall and maintains the drain tube end spaced from the bottom wall so that a seal is not formed between the bottom wall and the drain tube. The retaining webs generally define a first chamber and a second chamber, and the first and second chambers are in fluid communication. To assemble the water trap cup to the drain tube, the first chamber is aligned with the tube, and the cup is pushed upward into engagement with the drain tube until the drain tube end contacts the bottom stop.

18 Claims, 1 Drawing Sheet

WATER TRAP CUP

FIELD OF THE INVENTION

This invention relates generally to refrigerator appliances and, more particularly, to a water trap cup for a refrigerator.

BACKGROUND OF THE INVENTION

Known refrigerators typically includes an evaporator in air flow communication with a freezer compartment. In operation, condensation develops on the evaporator, and such condensation drips from the evaporator into a first water collection tray. To prevent the water from accumulating and possibly even freezing in the first water tray, the water in the first water collection tray flows out of the tray and into a drain tube. The drain tube includes an open end located in the refrigerator compressor compartment. The drain tube open end is typically located over a second water tray, and water drains out from the first tray, flows through the drain tube, and is discharged from the drain tube into the second water tray. Over time, if water accumulates in the second water tray, the second water tray may be emptied by a user.

Although the drain tube performs the important function of removing water from an area in communication with the freezer compartment, the drain tube also is a potential source of refrigerator inefficiency. Specifically, cold air from the freezer compartment can possibly escape from the freezer compartment through the tube. In addition, warmer air from the compressor compartment can possibly flow through the tube to the freezer compartment. Of course, it is undesirable to allow cold air to escape from the freezer compartment and to introduce warm air into the freezer compartment.

To prevent such undesired air flow, it is known to utilize a water trap in connection with the drain tube. The water trap prevents such air flow by acting as a barrier in the drain tube. Specifically, the water contained within the water trap prevents the free flow of air within the tube between the cold freezer compartment and the warmer compressor compartment.

A known water trap tube used in connection with a refrigerator is expensive to manufacture. Specifically, the subject water trap tube has an "S" shape, and water is trapped within curved sections of the tube. The tube is formed by a complex blow molding process which is expensive to implement and practice.

It would be desirable to provide a simple water trap configuration that is not expensive to manufacture. In addition, it would be desirable to provide such a water trap which is easily assembled to the drain tube, and which is effective in preventing free flow of air within the drain tube between the freezer compartment and the compressor compartment.

SUMMARY OF THE INVENTION

These and other objects may be achieved by a water trap cup which, in one embodiment, includes a bottom wall and a side wall which extends from the bottom wall and forms, with the bottom wall, a water trap. The side wall includes retaining webs configured for retaining an end of the drain tube within water trap cup, and a bottom stop extends from the side wall and maintains the drain tube end spaced from the bottom wall so that a seal is not formed between the bottom wall of the cup and the drain tube. The retaining webs generally define a first chamber and a second chamber, and the first and second chambers are in fluid communication.

To assemble the water trap cup to the drain tube, the first chamber is aligned with the tube, and the cup is pushed upward into engagement with the drain tube until the drain tube end contacts the bottom stop. In operation, water that travels through the drain tube and out the drain tube end flows from the water cup first chamber and into the second chamber. When the capacity of cup is exceeded, water flows out of cup and into a water collection tray in the compressor compartment.

A water trap is formed in water trap cup between the end of the drain tube and the bottom wall. The water trap substantially prevents warm compressor compartment air from entering into drain tube end and being injected into the freezer compartment. The water trap also substantially prevents cold freezer compartment air from escaping out through the drain tube into the compressor compartment.

The above described water trap cup can be molded using an inexpensive plastic and is simple to assemble to drain tube. In addition, the water trap cup is believed to be effective in substantially preventing free flow of air within the drain tube between the freezer compartment and the compressor compartment.

DETAILED DESCRIPTION OF THE DRAWINGS

Figure 1:
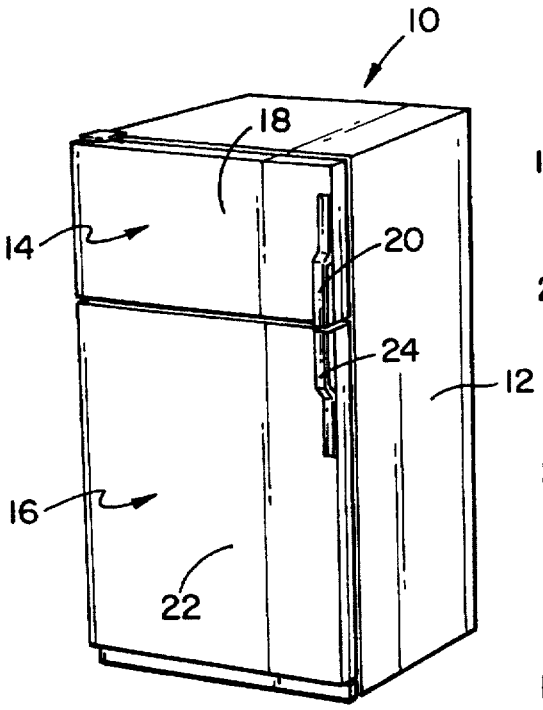
FIG. 1 is an elevated, perspective view of a typical household refrigerator.

FIG. 1 is an elevated, perspective view of an exemplary household refrigerator 10 which includes a cabinet 12 having a freezer compartment 14 and a fresh food compartment 16. A freezer door 18 having a handle 20 closes freezer compartment 14 and a fresh food door 22 having a handle 24 closes fresh food compartment 16. The water trap cup described below in more detail can be used in connection with refrigerator 10 as well as in many other refrigerator configurations, such as in a side-by-side type refrigerator. Refrigerator 10 may, for example, be refrigerator model number TBX18, commercially available from General Electric Company, Appliance Park, Louisville, Ky. 40225. In accordance with the present invention, such refrigerator would be modified to include the water trap cup described below.

Figure 2:
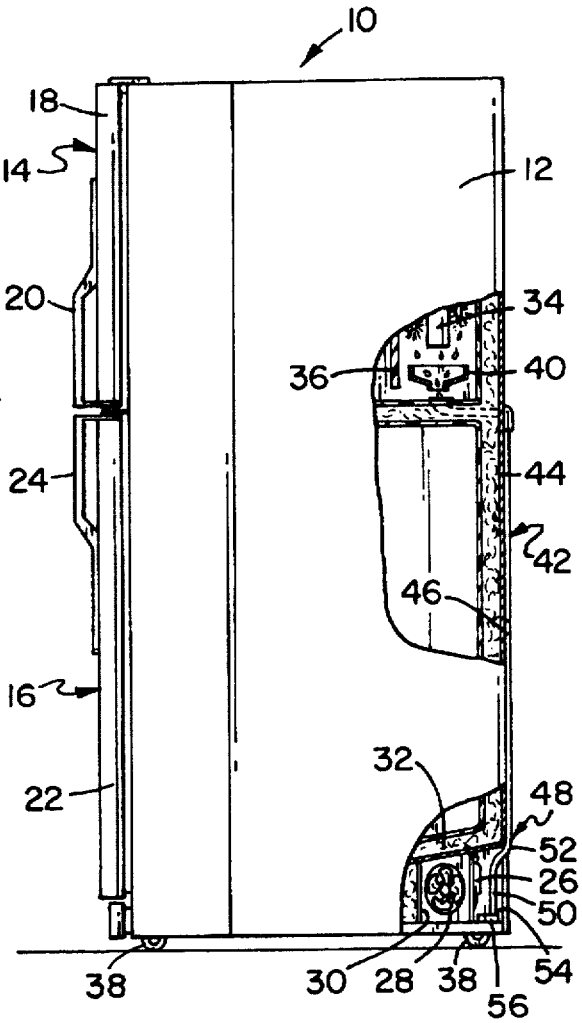
FIG. 2 is an elevated side view of the refrigerator shown in FIG. 1 with portions of the refrigerator cabinet cut away.

FIG. 2 is an elevated side view of refrigerator 10 with portions of refrigerator cabinet 12 cut away. As shown in FIG. 2, a compressor 26 and a compressor fan 28 are located in a compressor compartment 30 separated from fresh food compartment 16 by an insulating wall 32. Also, an evaporator 34 is in flow communication with freezer compartment 14, but is separated from freezer compartment 14 by a wall 36. Evaporator 34 is separated from fresh food compartment 16 by insulated wall 32. Generally, and as is well known, evaporator 34 is located within cabinet 12 at a first elevation, and a compressor 26 is located with cabinet 12 at a second elevation. The first elevation is above the second elevation. Cabinet 12 is supported on rollers 38.

A first water collection tray 40 is positioned to collect water from evaporator 34. A drain robe 42 is connected at a first end (not visible in FIG. 2) to first water collection tray 40, and a portion 44 of drain tube 42 extends along an exterior surface 46 of cabinet 12. Drain tube 42 includes a bend portion 48 which provides that a lower portion 50 of drain tube 42 passes through an opening 52 in cabinet 12 into compressor compartment 30 so that a second end 54 of drain tube 42 is located above a second water collection tray (not shown). The second water collection tray also is positioned to collect water from compressor 26.

In accordance with one embodiment of the present invention, a water trap cup 56 forms an interference fit with drain tube second end 54. Water trap cup 56 forms a water trap which substantially prevents warm compressor compartment air from entering into drain tube second end 54 and being injected into freezer compartment 14 through the drain tube first end. In addition, the water trap substantially prevents cold freezer air from escaping out through drain tube 42 into compressor compartment 30. The water trap therefore facilitates improving the efficiency of refrigerator operations.

Figure 3:
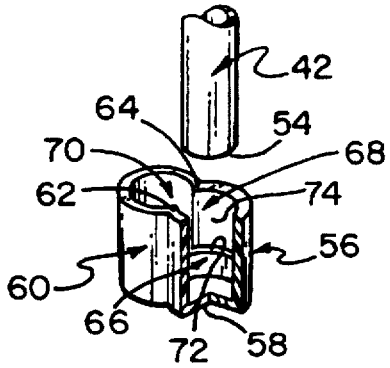
FIG. 3 is a perspective view of a water trap cup, with a portion of a sidewall cut away, in accordance with one embodiment of the present invention.

FIG. 3 is a perspective view of one embodiment of water trap cup 56 in accordance with the present invention. As shown in FIG. 3, water trap cup 56 includes a bottom wall 58 and a side wall 60 extending from bottom wall 58. Side wall 60 includes retaining webs 62 and 64 configured to form a tight fit with drain tube 42 and for retaining second end 54 of drain tube 42 within cup 56, i.e., below a top surface of cup 56. A bottom stop 66 is positioned within cup 56 for maintaining drain tube second end 54 spaced from bottom wall 58 so that a seal is not formed between bottom wall 58 and drain tube 42. Retaining webs 62 and 64 generally define a first chamber 68 and a second chamber 70. First and second chambers 68 and 70 are in fluid communication. Water trap cup 56 has a cross section area greater than a cross section area of drain tube second end 54.

Water trap cup bottom stop 66, in the embodiment shown in FIG. 3, is a ledge 72 formed integral with side wall 60, and ledge 72 extends from side wall 60 and is configured to contact second end 54 of drain tube 42. Ledge 72 extends around approximately about one-half an inner surface 74 of side wall 60 and extends on opposing sides of web 64 so that drain tube second end 54 can be inserted in either chamber 68 and 70 and be prevented from forming a seal with bottom wall 58.

Figure 4:
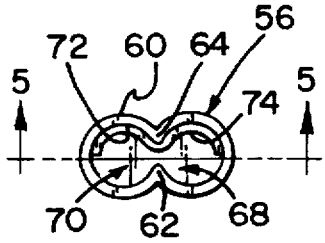
FIG. 4 is a top view of the water trap cup shown in FIG. 3.

FIG. 4 is a top view of water trap cup 56. As shown in FIG. 4, water trap cup 56 has a substantially figure 8 cross section shape. In addition, ledge 72 is shown in FIG. 4 as extending from inner surface 74 of side wall 60.

Figure 5:
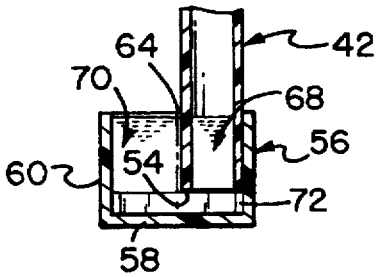
FIG. 5 is a cross section view of the water trap cup through line 5—5 shown in FIG. 4.

Referring to FIG. 5, which is a cross section view of water trap cup 56 through line 5—5 shown in FIG. 4, and with respect to assembly of water trap cup 56 to drain tube 42, first chamber 68 (or second chamber 70) is aligned with tube 42, and cup 56 is pushed over second end 54 until second end 54 contacts bottom stop 72. In operation, water that travels through drain tube 42 and is discharged from drain tube second end 54 may flow from first chamber 68 and into second chamber 70. When the capacity of cup 56 is exceeded, water flows out of cup 56 and into the second water collection tray referred to above in connection with FIG. 2.

A water trap 76 is formed in water trap cup 56 between second drain tube end 54 and cup bottom wall 58. Water trapped within water trap 76 prevents warm compressor compartment air from entering into drain tube second end 54 and from being injected into freezer compartment 14 through drain tube 42. Water trap 76 also prevents cold air from escaping out through drain tube into compressor compartment 30.

Water trap cup 56 can be molded using an inexpensive plastic (e.g., polyethylene or polypropolyne) and is simple to assemble to drain tube 42. In addition, and as explained above, water trap cup 56 is believed to be effective in substantially preventing the free flow of air within drain tube 42 between freezer compartment 14 and compressor compartment 30.

From the preceding description of the present invention, it is evident that the objects of the invention are attained. Although the invention has been described and illustrated in detail, it is to be clearly understood that the same is intended by way of illustration and example only and is not be taken by way of limitation. Accordingly, the spirit and scope of the invention are to be limited only by the terms of the appended claims.

What is claimed is:

1. A water trap cup for use in connection with a refrigerator, the refrigerator including an evaporator and a water collection tray positioned to collect water from the evaporator, a drain tube connected at a first end to the water collection tray and having an open second end positioned below the first end, said water trap cup comprising:

a bottom wall;

a side wall extending from said bottom wall and comprising a retaining web configured for retaining the second end of the drain tube by an interference fit; and a bottom stop for maintaining the drain tube second end spaced from said bottom wall.

2. A water trap cup in accordance with claim 1 wherein said cup has a cross section area greater than a cross section area of the second end of the drain tube.

3. A water trap cup in accordance with claim 1 wherein said bottom stop comprises a ledge integral with said side wall, said ledge extending from said side wall and configured to contact the second end of the drain tube.

4. A water trap cup in accordance with claim 1 wherein said cup has a substantially figure 8 cross section shape.

5. A water trap cup in accordance with claim 4 wherein said bottom stop comprises a ledge integral with said side wall, said ledge extending from said side wall and configured to contact the second end of the drain tube, said ledge extending around approximately about one-half an inner surface of said side wall.

6. A water trap cup in accordance with claim 5 wherein said bottom stop extends on opposing sides of said web.

7. A water trap cup in accordance with claim 1 wherein said cup is plastic.

8. A refrigerator comprising a cabinet including a freezer compartment and a fresh food compartment, an evaporator located within said cabinet at a first elevation, and a compressor located with said cabinet at a second elevation, said first elevation being above said second elevation, a first water collection tray positioned to collect water from said evaporator and a second water collection tray positioned to collect water from said compressor, a drain tube connected at a first end to said first water tray and having a second end located over said second water collection tray, a portion of said drain tube extending along an exterior surface of said cabinet, and a water trap cup connected to said drain tube at said second end, said water trap cup comprising a bottom wall and a side wall comprising a retaining web for retaining said second end of said drain tube within said water trap cup, said water trap cup further comprising a bottom stop for maintaining said drain tube second end spaced from said bottom wall.

9. A refrigerator in accordance with claim 8 wherein said water trap cup has a cross section area greater than a cross section area of said drain tube second end.

10. A refrigerator in accordance with claim 8 wherein said bottom stop comprises a ledge integral with said side wall, said ledge extending from said side wall and configured to contact said drain tube second end.

11. A refrigerator in accordance with claim 8 wherein said cup has a substantially figure 8 cross section shape.

12. A refrigerator in accordance with claim 11 wherein said bottom stop comprises a ledge integral with said side wall, said ledge extending from said side wall and extending around approximately about one-half an inner surface of said side wall.

13. A refrigerator in accordance with claim 12 wherein said bottom stop extends on opposing sides of said web.

14. A refrigerator in accordance with claim 8 wherein said cup is plastic.

15. A drain tube assembly for use in connection with a refrigerator, said drain tube assembly comprising:

a drain tube comprising a first end configured to be attached to a first water tray located at a first elevation, and a second end configured to be located over a second water tray at a second elevation, the first elevation being above said second elevation; and a water trap cup configured to be connected to said drain tube at said second end, said water trap cup comprising a bottom wall and a side wall extending from said bottom wall, and a retaining web configured for retaining, by interference fit, said second end of said drain tube within said water trap cup, said drain tube second end positioned within said cup below a top surface of said cup.

16. A drain tube assembly in accordance with claim 15 wherein said water trap cup has a cross section area greater than a cross section area of said drain tube second end.

17. A drain tube assembly in accordance with claim 15 wherein said water trap cup further comprises a bottom stop for maintaining said drain tube second end spaced from said bottom wall, said bottom stop comprising a ledge integral with said side wall, said ledge extending from said side wall and configured to contact said drain tube second end.

18. A drain tube assembly in accordance with claim 17 wherein said cup has a substantially figure 8 cross section shape, and said bottom stop comprises a ledge integral with said side wall, said ledge extending from said side wall and configured to contact said drain tube second end, said ledge extending around approximately about one-half an inner surface of said side wall.

* * * * *